United States Patent [19]

Adin

[11] 4,292,399

[45] Sep. 29, 1981

[54] COBALT (III) COMPLEX IMAGING COMPOSITIONS HAVING IMPROVED PHOTOGRAPHIC PROPERTIES

[75] Inventor: Anthony Adin, Rochester, N.Y.

[73] Assignee: Eastman Kodak Company, Rochester, N.Y.

[21] Appl. No.: 87,191

[22] Filed: Oct. 22, 1979

[51] Int. Cl.[3] ..... G03C 1/40; G03C 1/48; G03C 1/00; G03C 1/10

[52] U.S. Cl. ..... 430/338; 430/332; 430/340; 430/346; 430/374; 430/495; 430/541; 430/936

[58] Field of Search ..... 430/936, 346, 332, 340, 430/338, 374, 541, 495

[56] References Cited

U.S. PATENT DOCUMENTS

| | | | |
|---|---|---|---|
| 3,102,811 | 9/1963 | Barney | 430/332 |
| 3,630,735 | 12/1971 | Itano et al. | 430/337 |
| 3,708,297 | 1/1973 | Poot et al. | 430/337 |
| 3,874,946 | 4/1975 | Costa et al. | 430/346 |
| 4,075,019 | 2/1978 | DoMinh | 430/936 |
| 4,124,392 | 11/1978 | Adin et al. | 430/936 |
| 4,171,221 | 10/1979 | DoMinh | 430/936 |

FOREIGN PATENT DOCUMENTS 53-129028 11/1978 Japan .

OTHER PUBLICATIONS

"High gain . . . process", DoMinh et al., *Research Disclosure* No. 14614, 6/1976, p. 4.

"A current . . . redox chemistry", Adin et al., *Research Disclosure* No. 14719, 7/1976, p. 14.

"Imaging element using photoreductants", *Research Disclosure* No. 12617, 10/1974, pp. 12–30.

"Chlorination . . . Tuazines", Schaefer et al., *J Organic Chem.*, vol. 29, 1964, p. 1527.

"Transition metal . . . processes", Adin et al., *Research Disclosure* No. 15874, 6/1977, pp. 74–76.

"High gain . . . imaging", DoMinh, *Research Disclosure* No. 13505, 7/1975.

*Primary Examiner*—Richard L. Schilling

*Attorney, Agent, or Firm*—Dana M. Schmidt

[57] ABSTRACT

There is disclosed an image-forming composition and element comprising a cobalt(III) complex, a reducing agent precursor which, in the presence of reduction products of the complex, forms a reducing agent for the complex, and an organic oxidizing agent to improve the image properties of the composition.

15 Claims, No Drawings

COBALT (III) COMPLEX IMAGING COMPOSITIONS HAVING IMPROVED PHOTOGRAPHIC PROPERTIES

FIELD OF THE INVENTION

This invention relates to an image-forming composition and element featuring the reduction of a cobalt(III) complex in response to activating radiation to produce an image having an internal gain.

BACKGROUND OF THE INVENTION

Considerable effort has been made to develop imaging compositions particularly those useful in the graphic arts, which do not require the use of silver. The reason, of course, is the high cost of silver. One such nonsilver system involves the use of cobalt(III) complexes which are reduced as a result of a photolytic reaction to form as reaction products cobalt(II) and a released ligand, such as ammonia. Either of these can in turn be used to form images, the cobalt(II) being chelated by compounds capable of forming tridentate chelates, or the ammonia or other ligand being reacted with dye precursors, including diazo-coupler systems, to form a dye; or they can be used to bleach out preincorporated dye. Such compositions are disclosed in *Research Disclosure,* Vol 126, October, 1974, Publication No. 12617, Part III, published by Industrial Opportunities Limited, Homewell, Havant Hampshire PO91EF, United Kingdom. Amplification can be achieved by using a reducing agent precursor capable of producing internal gain by forming with the aforesaid reduction products a reducing agent for the reduction of remaining cobalt(III) complexes. For example, certain of said chelating compounds for cobalt(II) form when chelated a reducing agent, as described in *Research Disclosure,* Vol 135, July, 1975, Publication No. 13505. Alternatively, o-phthalaldehyde will react with ammonia to form a reducing agent, as disclosed in *Research Disclosure,* Vol 158, June, 1977, Publication No. 15874.

All such compositions feature the release of ligands, preferably amines. Quite often, however, the ligand release, particularly when amplified by the mechanisms noted above, has been discovered so effective in forming images that unwanted "image spread" or excessive contrast can occur. As a result, these compositions often exhibit very short processing latitude over time or temperature, or short exposure latitude such as when reproducing halftone dots. Although these processing and exposure latitude characteristics are useful in certain cases, particularly when photographing line copy, they can be undesirable in other application, such as in those reproducing continuous tone images, where extended processing and exposure latitude are advantageous.

Therefore, there has been a need to modify the cobalt(III) complex imaging compositions in a manner that will provide an imaging composition and element having improved photographic properties.

It has been known that halogenated methyl-s-triazines will react with ammonia, as noted by Schaeffer and Ross, "Chlorination and Bromination of Alkyl-s-Triazines", *J Organic Chemistry,* Vol 29, page 1527 (1964). However, there is no suggestion in this article that such a reaction can control photographic properties, or indeed that this reaction has any relation to recognized image-forming chemistry.

RELATED APPLICATIONS

Commonly owned U.S. Application Ser. No. 087,190 entitled "Cobalt(III) Complex Imaging Compositions Having Improved Photographic Properties", and cofiled with this application, by T DoMinh, discloses and claims the use of oxidizing agents with compounds which contain aromatic dialdehydes capable of forming reducing agent precursors for cobalt(III) complexes containing amine ligands.

SUMMARY OF THE INVENTION

In accordance with the present invention, there is advantageously provided an imaging composition and element utilizing cobalt(III) complexes and having improved photographic properties which correct the deficiencies noted above.

In a related feature of the invention there is provided such a composition and element, which not only use reducing agent precursors to amplify the cobalt(III) reduction, but also have increased resistance to thermal fog in $D_{min}$ areas and/or reduced contrast.

The aforesaid features of the invention arise from the discovery that organic oxidizing agents are capable of improving certain photographic properties of cobalt(III) complex-containing imaging compositions. More specifically, there is provided a light-sensitive image-forming composition, comprising in admixture (a) a reducible cobalt(III) complex; (b) a reducing agent precursor which forms, in the presence of reduction products of the complex, a reducing agent for the cobalt(III) complex; and (c) an organic oxidizing agent capable of functioning as an antifoggant in said composition.

The composition of the invention provides an improved imaging process comprising the steps of imagewise exposing the above-noted element to activating radiation, and developing the image formed.

Other features of the invention will become apparent upon reference to the following Description of the Preferred Embodiments.

DESCRIPTION OF THE PREFERRED EMBODIMENTS

High speed cobalt(III) complex imaging chemistry typically employs a reducing agent precursor to amplify the reduction of the cobalt(III) complex. Such precursors can be selected from a variety of materials, e.g., those which contain $\pi$-bonding systems and are capable of forming tridentate chelates with cobalt(III), or dye precursors such as phthalaldehyde. Each of these, however, can produce photographic effects peculiar to their chemistry which in some instances are less than satisfactory. To minimize these photographic effects, an organic oxidizing agent, discussed hereinafter, is added.

Cobalt(III) complexes capable of undergoing a reduction reaction to release their ligands are fully described in the literature. Any cobalt(III) complex containing releasable ligands and which is thermally stable at room temperature will function in this invention. Such complexes on occasion have been described as being "inert". See, e.g., U.S. Pat. No. 3,862,842, columns 5 and 6. However, the ability of such complexes to remain stable, i.e., retain their original ligands when stored by themselves or in a neutral solution at room temperature until a chemically or thermally initiated reduction to cobalt(II) takes place, is so well-known that the term "inert" will not be applied herein.

Such cobalt(III) complexes feature a molecule having a cobalt atom or ion surrounded by a group of atoms or other molecules which are generically referred to as ligands. The cobalt atom or ion in the center of these complexes is a Lewis acid, while the ligands are Lewis bases. While it is known that cobalt is capable of forming complexes in both its divalent and trivalent forms, trivalent cobalt complexes—i.e., cobalt(III) complexes—are employed in the practice of this invention because the ligands are relatively tenaciously held in these complexes and released when the cobalt is reduced to the (II) state.

Preferred cobalt(III) complexes useful in the practice of this invention are those having a coordination number of 6. A wide variety of ligands can be used with cobalt(III) to form a cobalt(III) complex. The one of choice will depend upon whether the image-forming material described hereinafter relies upon amines to generate or destroy a dye, or upon the chelation of cobalt(II) to form a dye density. In the latter case, amine ligands or nonamine ligands can be used, whereas in the former case amine ligands are preferred as the source of initiators for the image-forming reaction. Useful amine ligands include, e.g., methylamine, ethylamine, ammines, and amino acids such as glycinato. As used herein, "ammine" refers to ammonia specifically, when functioning as a ligand, whereas "amine" is used to indicate the broader class noted above. Highly useful with any of the destabilizer materials hereinafter described are the ammine complexes. The other amine complexes achieve best results when used with photoreductant as destabilizers as described hereinafter.

The cobalt(III) complexes useful in the practice of this invention can be neutral compounds which are entirely free of either anions or cations. As used herein, "anion" refers to a charged species which, in the commonly understood sense of the term, does not include species which are covalently bonded or bonded directly to the cobalt center. The cobalt(III) complexes can also include one or more cations and anions as determined by the charge-neutralization rule. Useful cations are those which produce readily soluble cobalt(III) complexes, such as alkali metals and quaternary ammonium cations.

A wide variety of anions can be used, and the choice depends in part on whether or not an amplifier is used which requires that the element be free of anions of acids having pKa values greater than about 3.5. For example, the anion(s) can be (a) $Q'_p—C_nH_m—CO_2^{\ominus}$ wherein n is an integer of from 0 to 20, m and p are each individually an integer of from 0 to 41, provided that if n and m are zero, p is zero; and Q' is alkoxy, alkyl, thio, hydroxy, carboxamido, sulfonamido, sulfonyl, sulfamyl, phosphonate, phosphinate, sulfato, carbonato, carbamato, carbonyl to form pyruvate, aryl or substituted aryl, —O—, or an electron-withdrawing group such as halogen, azide, cyanate, or thiocyanate; e.g., any perfluorocarboxylate or fully halogenated alkyl carboxylate;

(b) $C_nH_m—Q'_pSO_3^{\ominus}$ wherein n, m, p and Q' have the same meaning as described above, to form, for example, trifluoromethane sulfonate or $SO_3^{\ominus}$;

(c) $Q^2Q^3PO_4^{\ominus}$ wherein $Q^2$ and $Q^3$ are each independently aryl, alkyl, or substituted aryl or alkyl;

(d) $MQ^4$ wherein M is a group VA element other than nitrogen and $Q^4$ is halogen;

(e) $Q^2—SO_2N^{\ominus}SO_2Q^3$ wherein $Q^2$ and $Q^3$ are as defined above; and (f)

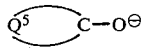

wherein $Q^5$ is the atoms necessary to form an aromatic or heterocyclic ring; provided that for each of these anions used with a reducing agent precursor that forms a tridentate chelate with cobalt(III), the pKa of the corresponding acid is $\leqq 3.5$. As used herein, unless otherwise stated, "alkyl" or "alkoxy" refers to a moiety having from 1 to about 10 carbon atoms, for example, methyl, ethyl, propyl, isopropyl, and the like, or methoxy, ethoxy, etc. "Aryl" or "aromatic" refers to a moiety containing from 6 to 10 carbon atoms, for example, phenyl or phenylene, naphthyl or naphthalene or the like.

Further details concerning the cobalt(III) complexes are recited in *Research Disclosure,* Vol 126, Publication No. 12617, October, 1974, Part III thereof, the details of which are expressly incorporated herein by reference.

The following Table I is a partial list of particularly preferred cobalt(III) complexes useful in the invention.

TABLE I hexa-ammine cobalt(III) benzilate
hexa-ammine cobalt(III) thiocyanate
hexa-ammine cobalt(III) trifluoroacetate
hexa-ammine cobalt(III) trifluoromethane sulfonate
hexa-ammine cobalt(III) perfluorobenzoate
hexa-ammine cobalt(III) heptafluorobutyrate
chloropenta-ammine cobalt(III) perchlorate
bromopenta-ammine cobalt(III) perchlorate
aquopenta-ammine cobalt(III) perchlorate
bis(methylamine) tetra-ammine cobalt(III) hexafluorophosphate
bis(dimethylglyoxime)ethylaquo cobalt(III)
cobalt(III) acetylacetonate
tris(2,2'-bipyridyl) cobalt(III) perchlorate
trinitrotris-ammine cobalt(III)
penta-ammine carbonate cobalt(III) perchlorate
tris(glycinato) cobalt(III)
tris(trimethylenediamine) cobalt(III) trifluoromethanesulfonate
tris(trimethylenediamine) cobalt(III) tetrafluoroborate
tris(ethylenediamine) cobalt(III) dimethane sulfonamidate
bis(ethylenediamine)bisazido cobalt(III) perchlorate
triethylenetetraaminedichloro cobalt(III) trifluoroacetate
aquopenta(methylamine) cobalt(III) nitrate
chloropenta(ethylamine) cobalt(III) pentafluorobutanoate
trinitrotris(methylamine) cobalt(III)
tris(ethylenediamine) cobalt(III) trifluoroacetate
bis(dimethylglyoxme)bispyridine cobalt(III) trichloroacetate
μ-superoxodecamine cobalt(III) perchlorate
trans-bis(ethylenediamine)chlorothiocyanato cobalt(III) perchlorate
trans-bis(ethylenediamine)bisazido cobalt(III) thiocyanate
cis-bis(ethylenediamine)ammineazido cobalt(III) trifluoroacetate
tris(ethylenediamine) cobalt(III) benzilate
trans-bis(ethylenediamine)dichloro cobalt(III) perchlorate
bis(ethylenediamine)dithiocyanato cobalt(III) perfluorobenzoate
triethylenetetraaminedinitro cobalt(III) dichloroacetate
tris(ethylenediamine) cobalt(III) succinate
tris(2,2'-bipyridyl) cobalt(III) perchlorate
bis(dimethylglyoxime)chloropyridine cobalt(III) and TABLE I-continued

| |
|---|
| bis(dimethylglyoxime)thiocyanatopyridine cobalt(III). |

The cobalt(III) complexes described above are themselves responsive to UV radiation, i.e., radiation of wavelengths less than 350 nm. In addition to exposure to such radiation, a destabilizer material can be added which causes release of the ligands from the complex upon appropriate exposure. Such destabilizers include 4-phenyl catechol, sulfonamidophenols and naphthols, cyclic acids such as phthalamic acid, ureas, amine salts, morpholine precursors, aminimides, triazoles, thiolate precursors, blocked mercaptotetrazoles, cyclic imides, barbituates, polymers containing pendant polysulfonamide moieties, and light-responsitive photoactivators responsive to wavelengths greater than 350 nm. Further description and detailed lists of such destabilizers can be found in "Inhibition of Image Formation Utilizing Cobalt(III) Complexes", *Research Disclosure,* Vol. 184, August, 1979, Publication No. 18436, the contents of which are expressly incorporated herein by reference.

Preferred examples of the photoactivators noted above are photoreductant destabilizers, and particularly quinone photoreductants. The quinones which are particularly useful as photoreductants include ortho- and para-benzoquinones and ortho- and para-naphthoquinones, phenanthrenequinones and anthraquinones. The quinones may be unsubstituted or incorporate any substituent or combination of substituents which do not interfere with the conversion of the quinone to the corresponding reducing agent. A variety of such substituents are known to the art and include, but are not limited to, primary, secondary and tertiary alkyl, alkenyl and alkynyl, aryl, alkoxy, aryloxy, alkoxyalkyl, acyloxyalkyl, aryloxyalkyl, aroyloxyalkyl, aryloxyalkoxy, alkylcarbonyl, carboxy, primary and secondary amino, aminoalkyl, amidoalkyl, anilino, piperindino, pyrrolidino, morpholino, nitro, halide and other similar substituents. Aryl substituents are preferably phenyl substituents. Alkyl, alkenyl and alkynyl substituents, whether present as sole substituents or present in combination with other atoms, typically contain about 20 or fewer (preferably 6 or fewer) carbon atoms.

A preferred class of photoreductants is internal hydrogen source quinones, that is, quinones incorporating labile hydrogen atoms. These quinones are more easily photoreduced than quinones which do not incorporate labile hydrogen atoms.

Further details and a list of useful quinone photoreductants of the type described above are set forth in *Research Disclosure,* Vol 126, October, 1974, Publication No. 12617, published by Industrial Opportunities Limited, Homewell, Havant Hampshire PO91EF, United Kingdom, the contents of which are hereby expressly incorporated by reference. Still others which can be used include 2-isopropoxy-3-chloro-1,4-naphthoquinone and 2-isopropoxy-1,4-anthraquinone.

With respect to the reducing agent precursors which amplify the reduction of the cobalt(III) complexes to cause additional release of ligands, examples of such reducing agent precursors include compounds which contain conjugated $\pi$-bonding systems rendering them capable of forming tridentate chelates with cobalt(III). Such compounds first form chelates with the reduced cobalt(II) formed by the first exposure, and then reduce remaining cobalt(III) complexes to form a cobalt(III) chelate, a colored species.

For this class, any compound can be used if it contains a conjugated $\pi$-bonding system capable of forming a chelate higher than a bidentate. Preferred are those forming a tridentate chelate with cobalt(III). As is well-appreciated by those skilled in the art, conjugated $\pi$-bonding systems can readily be formed by combinations of atoms such as carbon, nitrogen, oxygen and/or sulfur atoms, and typically include double-bond-providing groups such as vinyl, azo, azinyl, imino, formimidoyl, carbonyl and/or thiocarbonyl groups, in an arrangement which places the double bonds in a conjugated relationship. A variety of such compounds are known to the art including nitroso-arols, dithiooxamides, formazans, aromatic azo compounds, hydrazones and Schiff bases.

Preferred nitroso-arol chelating compounds are those defined by the formula:

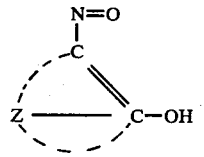

wherein Z is the atoms necessary to complete an aromatic nucleus, such as a phenyl or naphthyl nucleus.

Preferred dithiooxamides are those defined by the formula:

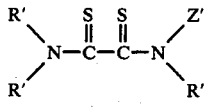

wherein Z' is a chelate ligand-forming group, for bonding with cobalt complexes as described above, and R' is in each instance chosen from Z', hydrogen, alkyl, alkaryl, aryl, and aralkyl.

Preferred formazan compounds are those defined by the formula: wherein

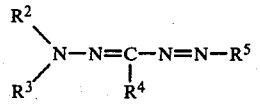

wherein $R^2$, $R^3$, $R^4$, and $R^5$ are independently chosen aromatic groups or hydrogen, provided that at least one of $R^2$ and $R^3$ is an aromatic group and the compound has a more than bidentate chelating capability.

Preferred aromatic azo compounds having the tridentate chelate-forming capability have the formula:

$$Z^2—N=N—Z^3$$

wherein $Z^2$ and $Z^3$ are independently chosen aromatic groups.

Preferred hydrazones having the tridentate chelate-forming capability are those having the formula:

$$Z^4—CH=N—NH—Z^5$$

wherein $Z^4$ and $Z^5$ are also independently chosen aromatic groups.

Preferred Schiff bases having the tridentate chelate-forming capability are those having the formula:

$$Z^6—CH=N—Z^7$$

wherein $Z^6$ and $Z^7$ are independently chosen aromatic groups.

Exemplary preferred chelate-forming compounds are as follows:

1-(2-pyridyl)-3-phenyl-5-(2,6-dimethylpheyl)formazan,
1-(2-pyridyl)-3-n-hexyl-5-phenyl-2H-formazan,
1-(2-pyridyl)-3,5-diphenylformazan,
1-(benzothiazol-2-yl)-3,5-diphenyl-2H-formazan,
1-(2-pyridyl)-3-phenyl-5-(4-chlorophenyl)formazan,
1,1'-di(thiazol-2-yl)-3,3'-diphenylene-5,5'-diphenylformazan;
1,3-didodecyl-5-di(benzothiazol-2-yl)-formazan,
1-phenyl-3-(3-chlorophenyl)-5-benzothiazol-2-yl)formazan,
1,3-dicyano-5-di(benzothiazol-2-yl)formazan,
1-phenyl-3-propyl-5-(benzothiazol-2-yl)formazan;
1,3-diphenyl-5-(4,5-dimethylthiazol-2-yl)formazan,
1-(2-quinolinyl)-3-(3-nitrophenyl)-5-phenylformazan,
1-(2-pyridyl)-3-(4-cyanophenyl)-5-(2-tolyl)formazan,
1,3-naphthalene-bis[2-(2-pyridyl)-5-(3,4-dichlorophenyl)formazan],
1-(2-pyridyl)-5-(4-nitrophenyl)-3-phenylformazan,
1-(benzothiazol-2-yl)-3,5-di(4-chlorophenyl)formazan,
1-(benzothiazol-2-yl)-3-(4-iodophenyl)-5-(3-nitrophenyl)formazan,
1-(benzothiazol-2-yl)-3-(4-cyanophenyl)-5-(2-fluorophenyl)formazan,
1-(4,5-dimethylthiazol-2-yl)-3-(4-bromophenyl)-5- (3-trifluorophenyl)formazan,
1-benzoxazol-2-yl)-3,5-diphenylformazan,
1-(benzoxazol-2-yl)-3-phenyl-5-(4-chlorophenyl)-formazan,
1,3-diphenyl-5-(2-pyridyl)formazan,
1-(2,5-dimethylphenyl)-3-phenyl-5-(2-pyridyl)formazan,
N-(2-pyridyl)-dithiooxamide,
N,N'-di(2-pyridyl)-dithiooxamide,
N-(2-benzothiazolyl)dithiooxamide,
N-(2-quinolinyl)-dithiooxamide,
1-(2-pyridylazo)-2-naphthol,
1-(2-pyridylazo)resorcinol,
2-pyridinecarboxaldehyde-2-quinolylhydrazone,
disodium 1-nitro-2-naphthol-3,6-disulfonate,
2-nitrosophenol,
1-nitroso-2-naphthol,
2-nitroso-1-naphthol,
1-nitroso-3,6-disulfo-2-naphthol,
disodium-1-nitroso-2-naphthol-3,6-disulfonate,
4-nitrosoresorcinol,
2-nitroso-4-methoxyphenol,
1-(2-pyridyl)-3-phenyl-3-(2,6-dimethylpheyl)formazan,
1-(4,5-dimethylthiazol-3-yl)-3-(4-bromophenyl)-5-(3-trifluoromethylphenyl)formazan,
1,3-diphenyl-5-(benzothiazol-2-yl)formazan,
1,3-diphenyl-5-(2-quinolinyl)formazan,
1-phenylazo-2-phenol,
1-(2-hydroxyphenylazo)-2-naphthol,
1-(2-pyridylazo)-2-phenol,
4-(2-pyridylazo)resorcinol,
1-(4-nitro-2-thiazolylazo)-2-naphthol,
1-(2-benzothiazolylazo)-2-naphthol,
2-pyridinecarboxyaldehyde-2-pyridylhydrazone,
2-pyridinecarboxyaldehyde-2-benzothiazolyhydrazone,
2-thiazolcarboxyaldehyde-2-benzoxazolylhydrazone,
1-(N-2-pyridylformimidoyl)-2-naphthol,
1-(N-2-thiazolylformimidoyl)-2-naphthol,
1-(N-2-benzoxazolylformimidoyl)-2-phenol,
2-(N-2-pyridylformimidoyl)phenol,
2-(N-2-pyridylimidoyl)pyridine, and
1-(2-benzoxazolecarboxaldehyde-imino)-2-oxazole.

1-(2-pyridylazo)-2-naphthol and 1-(2-pyridylazo)resorcinol are the most preferred.

Further details and additional examples are set forth in U.S. Pat. No. 4,075,019 issued Feb. 21, 1979 to DoMinh, the contents of which are expressly incorporated herein by reference.

As mentioned in the aforesaid DoMinh patent, the chelating compounds are preferably used as the reducing agent precursors in coatings which are predominantly free of anions of acids having pKa values greater than about 3.5.

As described in the aforementioned DoMinh application, another and preferred class of reducing agent precursors which amplifies the reduction of the cobalt(III) complexes is aromatic dialdehydes. The currently preferred species of such dialdehydes is o-phthalaldehyde, hereinafter "phthalaldehyde". In such a case, the ligands of the cobalt(III) complex are preferably amine ligands. Phthalaldehyde appears to undergo the following reaction, in the presence of the released amines, to provide amplification in the exposed areas, as well as a dye (B):

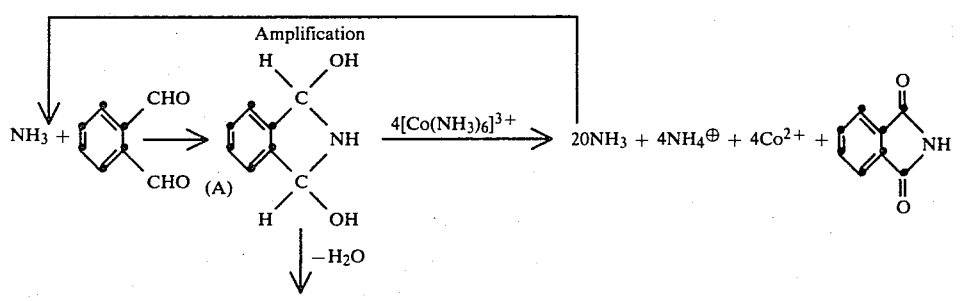

1

-continued

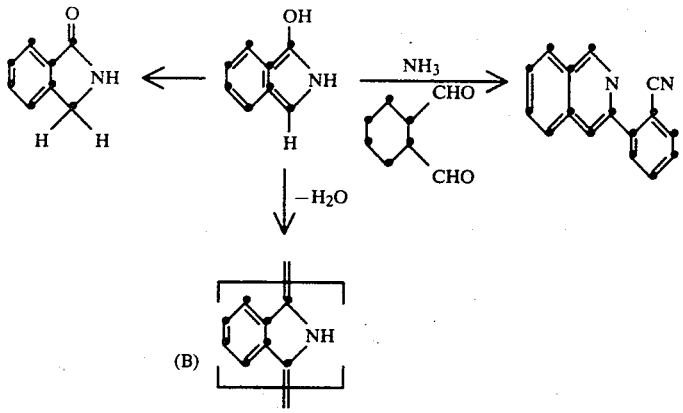

Further details of the phthalaldehyde reaction are set forth in DoMinh et al, "Reactions of Phthalaldehyde with Ammonia and Amines", *J Org Chem*, Vol 42, Dec. 23, 1977, p 4217.

Each of these two classes of reducing agent precursors has photographic effects that can be improved. The conjugated $\pi$-bonding compounds which form tridentate chelates with cobalt(III) tend to fog thermally at $D_{min}$ (minimum density) areas. However, if phthalaldehyde is the reducing-agent precursor, the problem is not thermal fog, but high contrast values. Surprisingly, it has been found that organic oxidizing agents are useful in dealing with the differing problems of both classes of reducing-agent precursors.

Preferred organic oxidizing agents are those which meet the following test: when 1 to 2 mg are added to a 2 g solution mixture of about 0.19 g of a binder such as a polyaldehyde, 0.03 mmoles of a cobalt(III) complex, and 0.04 mmoles of a reducing agent precursor in 1.8 g of a suitable solvent or solvent mixture, and coated and dried, and subsequently heated unexposed, face up on a 125° C. hot block, the length of time required to fog the sample is greater than the same sample prepared without any organic oxidizing agent.

Useful oxidizing agents that are capable of functioning as antifoggants can be selected from the following:

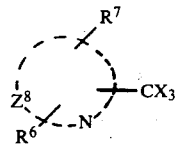

(I)

wherein $R^6$ and $R^7$ are the same or different and each is $CX_3$, H, or $CH_3$; and $Z^8$ is the atoms necessary to complete one or more aromatic rings containing one or more hetero atoms, such as pyridyl, benzimidazolyl, benzothiazolyl, thiazolyl and quinolinyl; and X is halogen such as bromine and chlorine;

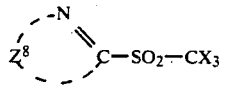

(II)

wherein $Z^8$ and X are as defined above;

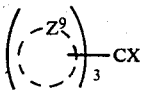

(III)

wherein $Z^9$ is the number of atoms necessary to complete an aryl ring, such as phenyl; and X is as defined above;

$$R^8—SO_2—CBr_3 \quad (IV)$$

wherein $R^8$ represents oxazole, benzoxazole, thiazole, benzothiazole, phenyl, tolyl, benzyl, or the group $(R^9—_3C—CH_2—_n$ wherein n is an integer of from 0 to 4; $R^9$ is H or X, and X is as defined above;

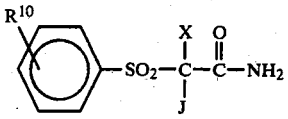

(V)

wherein $R^{10}$ is hydrogen or methyl, J is hydrogen or X, and X is as defined above;

(IV) iodoso-substituted benzenes, such as iodosobenzene diacetate and those having the structure

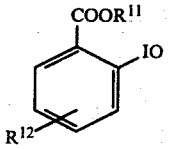

wherein $R^{11}$ and $R^{12}$ are each individually hydrogen or a straight chain or branched alkyl having from 1 to about 12 carbon atoms, examples of which are o-iodosobenzoic acid, methyl o-iodosobenzoate, octyl o-iodosobenzoate, 2-iodoso-4-methylbenzoic acid, and methyl 2-iodoso-4-methylbenzoate;

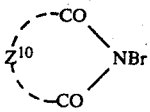

(VII)

wherein $Z^{10}$ is the number of atoms necessary to complete a ring together with —CO—NBr—CO to which $Z^{10}$ is bonded, for example

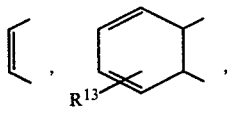

etc., wherein $R^{13}$ has the same significance as $R^{12}$, examples including N-bromosuccinic acid imide and N-bromophthalic acid imide;

$R^{14}$—CONHBr (VIII)

wherein $R^{14}$ represents a straight chain or branched alkyl having from 1 to about 21 carbon atoms, examples of which include N-bromoacetamide, and N-bromostearic acid amide;

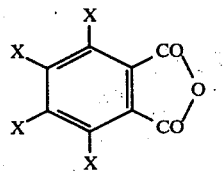

(IX)

wherein X is as defined above, examples of which include tetrachlorophthalic anhydride and tetrabromophthalic anhydride;

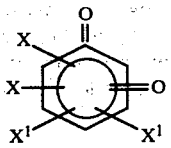

(X)

wherein X is as defined above and $X^1$ is cyano or X, of which examples include 3,4,5,6-tetrachloro-1,2-benzoquinone; 2,3,5,6-tetrabromo-1,4-benzoquinone; 2,3-dichloro-5,6-dicyano-1,4-benzoquinone, and 2,3-dibromo-5,6-dicyano-1,4-benzophenone;

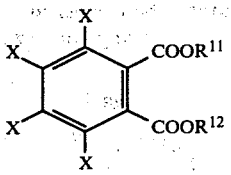

(XI)

wherein $R^{11}$, $R^{12}$ and X are as defined above, examples of which include tetrachlorophthalic acid; tetrachlorophthalic acid, monomethyl ester; tetrachlorophthalic acid, diethyl ester; and tetrachlorophthalic acid,dioctyl ester; and

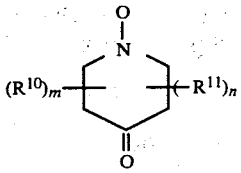

(XII)

wherein $R^{10}$ and $R^{11}$ are as defined above, and m and n are each individually 0, 1, or 2 (joined to the same carbon atom), an example of which is 2,2,6,6-tetramethyl-4-oxa-piperidino oxy.

A preferred form of the oxidizing agent of class (I) is

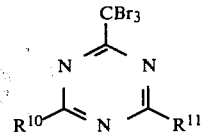

(I')

wherein $R^{10}$ and $R^{11}$ are the same or different and are each H, methyl or $CBr_3$. Thus, the currently preferring oxidizing agent is 2,4-bis(tribromomethyl)-6-methyl-s-triazine.

Although the exact mechanism by which these agents improve the photographic properties is not completely understood, it is believed it is one of oxidation. For example, in the case of phthalaldehyde as the reducing-agent precursor providing an amplification of the reduction of cobalt(III), and of 2,4-bis(tribromomethyl)-6-methyl-s-triazine as the oxidizing agent, it is believed the reaction proceeds as follows:

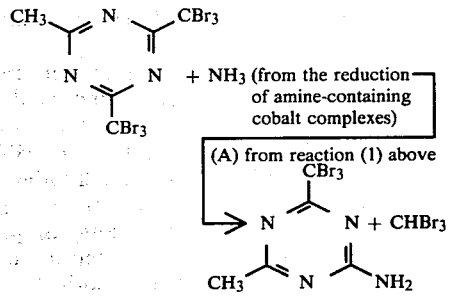

(4)

Further details of reactions such as 4) above are described by F Schaeffer et al, *J Org Chem,* Vol 29, p 1527 (1964).

In the case of compounds capable of forming tridentate chelates as the reducing-agent precursor, the oxidizing agents appear to function as antifoggants.

Yet another class of materials which function as reducing-agent precursors to provide an amplified reduction of the cobalt(III) complexes, and which are useful as such in this invention, are blocked dye precursors.

"Dye precursor" means any compound capable of being oxidized to a form which is either itself the desired dye or which is capable of combining with another compound in the element, such as a color coupler, without further processing, to form the desired dye. Thus, preferred examples of such dye precursors include leuco dyes which already contain a color coupler as part of the compound and color-developing agents. Known color-developing agents include primary aromatic amines, such as p-phenylenediamines, p-aminophenols and sulfonamido anilines.

"Blocked dye precursor" means a dye precursor to which a group or radical is attached so as to interfere with the ability of the dye precursor to be oxidized. In the case of coupler-containing dye precursors, such as leuco dyes, the blocking group is preferably a carbonyl which has displaced the hydroxyl hydrogen of a phenol moiety or is attached to a conjugated nitrogen atom which links the coupler to the remainder of the dye. In the case of color-developing agents, such as p-phenylenediamines not yet coupled, the block mechanism can be by the protonation of one or both of the two amine groups which, when deprotonated, forms an amine group capable of being oxidized in a redox reaction with the cobalt complex, or by acetylation.

Blocked dye precursors are preferably selected for use with cobalt(III) complexes containing amine ligands, as defined above. Exposure to activating radiation causes the formation of a free amine, and this amine unblocks the dye precursor. The dye precursor is then capable of undergoing a redox reaction with remaining cobalt(III) complexes to produce more free amine, etc. The oxidized form of the dye precursor can itself be a dye, as in the case of leuco dyes which are converted to the dye form by the redox reaction; or, alternatively, the blocked dye precursor can be a protonated color developer, the unprotonated form of which, when oxidized, can combine with a color coupler which is either preincorporated into the composition or is added during development.

Blocked leuco dyes particularly useful in this embodiment of the invention have the structures:

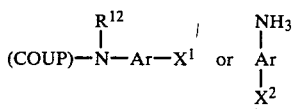

wherein COUP is a photographic color-forming coupler linked to said nitrogen atom through a carbon atom at the coupling position, such as, for example, a phenolic coupler, a pyrazolone coupler, a pyrazolotriazole coupler, couplers having open-chain active methylene groups and the like, and soluble couplers which have solubilizing groups attached thereto to provide a diffusible coupler, and the like;

Ar is an aromatic group containing from about 6 to about 20 carbon atoms, including substituted and unsubstituted phenylene and naphthylene groups, and the like, and is preferably a phenylene group which is preferably substituted with halogen atoms or groups containing halogen atoms in the ortho and/or meta position of the ring;

$X^1$ can be an amino group, including substituted amines, or preferably is a hydroxyl group or the radical $-O-R^{13}$, wherein $R^{13}$ is a carbonyl-containing group such as a group of the formula:

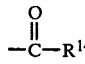

$R^{14}$ being a group containing 1 to about 12 carbon atoms which can be an alkyl group or substituted equivalents thereof such as haloalkyl alkoxy, aminoalkyl and the like; or an aryl group or substituted equivalents thereof such as halo-aryl, alkylaryl, aryloxy and the like;

$R^{12}$ is a hydrogen atom or the same substituent as $R^{13}$, provided that at least one of $R^{12}$ and $R^{13}$ is a carbonyl-containing group;

and $X^2$ is

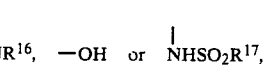

and $R^{15}$, $R^{16}$ and $R^{17}$ are alkyl groups or alkylsulfonyl groups, such as sulfonamidoalkyl, preferably having from 1 to about 10 carbon atoms.

Preferably, $R^{14}$ is an alkyl group having 1 to about 4 carbon atoms. The group defined as Ar above is preferably the residue of an aromatic color-developing agent such as an aminophenol, a phenylenediamine and the like and, of course, including the various substituents on the aromatic group which are known in the art for the respective color-developing agent. In one preferred embodiment where Ar is the mnucleus of an aminophenol developing agent, it can contain the same substituents as disclosed, for example, on the aminophenol developing agents disclosed by Bush et al, U.S. Pat. No. 3,791,827 issued Feb. 12, 1974. Further details on coupler definitions are found in U.S. Pat. No. 3,620,747 issued Nov. 16, 1971, and in the aforesaid Bush patent.

Additional details and lists of specific examples of such blocked dye precursors are given in *Research Disclosure*, Vol 152, Pub 15246, December, 1976, the contents of which are expressly incorporated herein by reference.

The blocked dye precursors described above can also be used in admixture with the $\pi$-bonding, chelate-forming compounds first described above as examples of reducing-agent precursors.

Certain materials can be added as optional ingredients. For example, if the composition is to be coated as a film on a support, as opposed to being sprayed into filter paper, a binder is desirable. Any binder compatible with cobalt(III) complexes can be used, for example, the binders listed in the aforesaid Publication No 12617 of *Research Disclosure*, especially paragraph I(D), the details of which are expressly incorporated herein by reference. Typical of such binders are acetates, cellulose compounds, vinyl polymers, polyacrylates and polyesters. In addition, in those embodiments relying upon phthalaldehyde as the dye-forming material and/or as the reducing-agent precursor, the binder can be selected to maximize the maximum neutral densities produced during exposure and development. Highly preferred examples of such binders include certain polysulfonamides, for example, poly(ethylene-co-1,4-cyclohexylenedimethylene-1-methyl-2,4-benzenedisulfonamide), poly(ethylene-co-hexamethylene-1-methyl-2,4-benzenedisulfonamide) and poly(methacrylonitrile).

Yet other optional ingredients include additional materials for forming a detectable product in the imagewise-exposed areas beyond the optically dense cobalt(III) chelate or the oligomer dye (B) described above. A preferred form of such additional discriminating materials is one which will form a polymer and preferably an inkable polymer such as can be used to provide a lithographic printing plate. Particularly useful polymers are polyaldehydes capable of being crosslinked by amines to form a photohardened layer. Most preferred examples of such polyaldehydes are those described in *Research Disclosure*, Vol 181, Publication No 18183 (May, 1979), the details of which are expressly incorporated herein by reference, e.g., a polymer having recurring units with the structure:

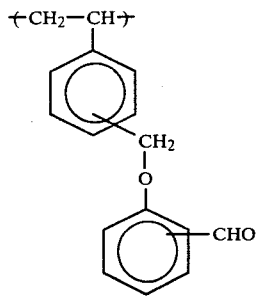

Still another, optional discriminating material is an amine-responsive image-recording layer of the type described in the aforesaid *Research Disclosure,* Publication No 13505, Paragraph V(K).

If the image-forming composition is to be coated on a support to form an element, any of the supports listed in the aforesaid *Research Disclosure*, Publications 12617 or 13505, can be used, e.g., poly(ethylene terephthalate) film.

The coating solvent selected will, of course, depend upon the makeup of the composition, including the binder, if any. Typical preferred solvents which can be used alone or in combination are lower alkanols, such as methanol, ethanol, isopropanol, t-butanol and the like; ketones, such as methylethyl ketone, acetone and the like; water; ethers, such as tetrahydrofuran, and the like; acetonitrile; dimethyl sulfoxide and dimethylformamide.

The proportions of the nonbinder reactants forming the composition and/or the imaging element can vary widely, depending upon which materials are being used. Because, in any event, cobalt(III) complex is present, the molar amounts are expressed per mole of complex. The amount of the oxidizing agent which is to be added depends in part upon the desired photographic effect. It also depends in part on the species used as the reducing-agent precursor. In those cases in which the reducing-agent precursor is a chelating compound capable of forming a tridentate chelate with cobalt(III), the amount can be between 0.1 mole per mole of cobalt(III) complex, and about 10 moles per mole. If the reducing-agent precursor is a dye precursor such as phthalaldehyde, the amount can be between about 1 mole per mole of cobalt(III) complex and about 15 moles per mole.

A convenient range of coating coverage of cobalt(III) complex is between about 5 and about 50 mg/dm$^2$.

Typically, solutions are coated onto the support by such means as whirler coating, brushing, doctor-blade coating, hopper coating and the like. Thereafter, the solvent is evaporated. Other exemplary coating procedures are set forth in the *Product Licensing Index,* Vol 92, December, 1971, Publication No 9232, at page 109, published by Industrial Opportunities Limited, Homewell, Havant Hampshire P091EF, United Kingdom. Addenda such as coating aids and plasticizers can be incorporated into the coating composition.

In certain instances, an overcoat for the radiation-sensitive layer of the element can supply improved handling characteristics and can help to retain otherwise volatile components. Useful examples include gelatin overcoats crosslinked with an agent, such as a 5 weight percent aqueous solution of hexamethoxymethyl melamine and various copolymers.

The image-forming composition described above, preferably as a coated element, is exposed imagewise to a suitable light source, for example, an IBM Microcopier IID, and the development of the image is completed in a rapid manner by heating the element to a temperature of between about 90° and about 160° C., for a time of between about 2 and about 30 seconds. In such a heating process, the oxidizing agents of the invention serve, at least when phthalaldehyde is the reducing-agent precursor, to increase the available exposure and processing latitude of the element. One convenient measure of such exposure latitudes is the contrast control available to the composition. To the extent the composition has a reduced contrast, the greater is the latitude in exposure which is available over usual density values. The preferred oxidizing agent of the invention demonstrates a marked reduction in the contrast which would result if the oxidizing agent were not included.

Another technique for measuring the effect of the oxidizing agent on exposure latitude is by determining the exposure range which will reproduce an integrated density of halftone dots to a value which is 0.75 to 1.25 times that of the actual value of the original dot images. In other words, the oxidizing agents reduce the "image spread". The preferred oxidizing agent of the invention can provide such a halftone-dot reproduction over at least 0.3 log E exposure when phthalaldehyde is the reducing-agent precursor. When exposure latitude is measured by this technique, the amount of oxidizing agent which is required is generally less than is required for preferred contrast control.

The following examples are included for a further understanding of the invention.

EXAMPLES 1-6

To demonstrate the antifoggant properties of the oxidizing agents when used with, e.g., a reducing agent precursor capable of forming a tridentate chelate with cobalt(III), the following coating solutions were prepared. (w/w means weight per weight of solvent.

| | |
|---|---|
| Solution 1: | |
| acetone | 20 g |
| tris(trimethylenediamine)cobalt(III) trifluoromethanesulfonate | 180 mg |
| tris(trimethylenediamine)cobalt(III) tetrafluoroborate | 150 mg |
| Solution 2: (Polyaldehyde solution) | |
| 20% (w/w) of poly(o-formylphenylvinylbenzyl ether) in tetrahydrofuran | 10 g |
| 20% (w/w) of poly(o-formylphenylvinylbenzyl ether) in cyclopentanone | 10 g |
| 1-(2-pyridylazo)-2-naphthol (PAN) (reducing agent precursor) | 200 mg |
| 2-isopropoxy-1,4-naphthoquinone | 400 mg |

To 1 g of Solution 1 were added 1-2 mg of the oxidizing agents listed in Table II as antifoggants. After dissolution, 1 g of Solution (2) was then added and stirred. The solution was then coated with a 100-micron doctor blade on subbed poly(ethylene terephthalate) support and dried sequentially for 1 min at 21° C., 1 min at 66° C., and 1 min at 100° C.

Strips of each coating were then evaluated in terms of:

(1) fog time (expressed as seconds required for a visible green color of dye to appear from the chelating of cobalt with the PAN in an unexposed coating with thermal processing, face up, on a 125° C. hot block).

(2) speed (expressed as the number of 0.3 log E steps of green dye visible after a ½-sec exposure through a 1.0 neutral density filter and a 0.3 log E step tablet in an IBM Microcopier IID exposing apparatus and processing, as above, to a point 1 sec short of fog).

TABLE II

| Example | Antifoggant | Fog Time | Speed | Dmax |
|---|---|---|---|---|
| control | none | 6 sec | 4 | 0.28 |
| 1 | 2-(tribromomethyl)quinline | 21 sec | 3 | 0.20 |
| 2 | 2-(tribromomethyl)-quinoxaline | 22 sec | 2 | 0.17 |
| 3 | 2-tribromomethyl-sulfonyl benzothiazole | 25 sec | 3 | 0.26 |
| 4 | 2,4-bis(tribromomethyl)-6-methyl-s-triazine | 30 sec | 2 | 0.14 |
| 5 | chlorotriphenylmethane | 35 sec | 2 | 0.37 |
| 6 | bis(tribromomethyl)-sulfone | >40 sec | 1 | 0.08 |

Thus, Examples 1–6 demonstrated antifoggant properties by drastically increasing the heating time necessary to fog the composition, compared with the control which lacked the oxidizing agent. The small loss in speed is an expected adjunct of the antifoggant property.

EXAMPLES 7–9

The procedure of Example 1 was repeated, except that the polyaldehyde used was 1.4 g of a 15% (w/w) solution of polyvinyl butyral available under the trademark BUTVAR from Monsanto, in acetone, and the antifoggants were those shown in Table III. The two coating solutions were modified as follows:

| | |
|---|---|
| Solution A: | |
| acetone | 2 g |
| tris(trimethylenediamine)cobalt(III) trifluoromethanesulfonate | 60 mg |
| tris(trimethylenediamine)cobalt(III) tetrafluoroborate | 50 mg |
| Solution B: | |
| acetone | 2 g |
| 1-(2-pyridylazo)-2-naphthol (as in Ex. 1) | 33 mg |
| 2-isopropoxy-1,4-naphthoquinone | 133 mg |

These solutions were placed in a refrigerator and used as soon as possible after preparation. A coating dope was prepared by mixing 0.3 g of A and 0.3 g of B with the polyvinyl butyral. An antifoggant in the amount of 1–2 mg was added to the mixture as described in the table. The solution was then coated with a 100-micron doctor blade on subbed poly(ethylene terephthalate) and dried sequentially at 21° C. for 1 min and 60° C. for 4 min.

The time for the appearance of fog when held face up on a 125° C. hot block was measured. The film was exposed for about ½ sec in an IBM Microcopier IID exposing apparatus through an 0.3 log E step tablet and 1.0 neutral density filter. The film sample was then processed on the 125° C. hot block as described earlier. The red diffuse Dmax and the number of 0.3 log E steps (speed) developed were measured.

TABLE III

| Example | Antifoggant (1–2 mg) | Fog Time | Speed | Dmax |
|---|---|---|---|---|
| control | none | 7 sec | 7 | 0.31 |
| 7 | 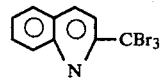 | 10 sec | 6 | 0.29 |
| 8 | 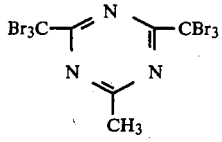 | 15 sec | 5 | 0.32 |
| 9 | 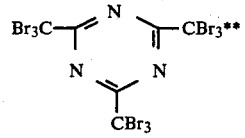 | 30 sec | 5 | 0.32 |

**Prepared according to Journal of Organic Chemistry, Vol 29, p 1527 1964.

Examples 7 and 8 used the same antifoggants as were used in Examples 2 and 5, respectively, and although the fogging times were comparatively reduced, they were still improved compared with the faster fogging time which existed for the control.

EXAMPLES 10–14

Example The procedure of was repeated, using the antifoggants of the following Table IV.

TABLE IV

| Example | Antifoggant | Fog Time | Speed (# of 0.3 log E Steps | $D_{max}$ |
|---|---|---|---|---|
| Control | none | 11 sec. | 6 | 0.30 |
| 10 | 2,2,6,6-tetramethyl-4-oxo-piperidino oxy | 30 sec. | 6 | 0.31 |
| 11 | iodosobenzene diacetate | 20 sec. | 4 | 0.26 |
| 12 | tetrachloro-phthalic anhydride | 25 sec. | 6 | 0.27 |
| 13 | tetrachloro-o-benzoquinone | 32 sec. | 4 | 0.22 |
| 14 | N-bromosuccinimide | >50 sec. | 3 | 0.13 |

EXAMPLES 15–21

To demonstrate contrast control using 2,4-bis(tribromomethyl)-6-methyl-s-triazine as the oxidizing agent, the dopes listed below were coated at approximately 100-micron wet thickness on subbed poly(ethylene terephthalate) film support on a 32° C. hot block, held there for 1 min, and then heated for 5 additional min at 60° C. Where overcoated, a 4.3% aqueous solution of poly(acrylamide-co-N-vinyl-2-pyrrolidinone-co-2-acetoacetoxyethylmethacrylate), hereinafter AVPA, (50:45:5 monomer weight ratios) was coated in the same manner.

| | |
|---|---|
| phthalaldehyde | 0.320 g |
| hexa-amminecobalt(III) trifluoroacetate | 0.200 g |
| 2-isopropoxy-1,4-naphthoquinone | 0.0108 g |
| poly(ethylene-co-1,4-cyclohexylene-dimethylene-1-methyl-2,4-benzene-disulfonamide) | 1.90 g |
| 2,4-bis(tribromomethyl)-6-methyl-s-traizine | see Table IV |
| dimethyl polyoxyalkylene ether copolymer available under the trade- | 0.040 g |

-continued

| | |
|---|---|
| mark "SF-1066 Surfactant" from General Electric | |
| acetone | 7.6 g |

The sensitometry of the elements was determined from transparencies prepared by contact-exposing the elements for 8 sec through a 0.3 log E silver step tablet in an IBM Microcopier IID exposing device (with a 400-watt, medium-pressure mercury arc lamp). The image was developed by contacting the back of the film for 5 sec to a 140° C. hot block.

Neutral densities of the black negative-working images were determined, contrast (γ) was measured as the slope of the straight-line portion of the curve, and toe speed was measured as the number of visible steps. The results, both with and without an AVPA overcoat, are tabulated in Table IV.

TABLE IV

| | | | No Overcoat | | | AVPA Overcoat | | |
|---|---|---|---|---|---|---|---|---|
| Example | mg Triazine | mmoles Triazine | Toe Speed | $D_{max}^N$ | γ | Toe Speed | $D_{max}^N$ | γ |
| control | 0 | 0 | 6 | 2.49 | 2.9 | 6 | 2.49 | 3.0 |
| 15 | 0.239 | 0.00040 | 6 | 2.30 | 2.6 | 6 | 2.42 | 3.0 |
| 16 | 2.39 | 0.0040 | 6 | 2.21 | 2.4 | 6 | 2.32 | 2.6 |
| 17 | 2.98 | 0.0050 | 6 | 2.19 | 2.4 | 6 | 2.29 | 2.6 |
| 18 | 5.97 | 0.010 | 6 | 2.04 | 2.0 | 6 | 2.13 | 2.3 |
| 19 | 11.9 | 0.020 | 6 | 1.79 | 1.9 | 6 | 1.83 | 1.9 |
| 20 | 17.9 | 0.030 | 6 | 1.50 | 1.0 | 6 | 1.50 | 1.15 |
| 21 | 23.9 | 0.040 | 6 | 0.94 | 0.58 | 6 | 1.08 | 0.73 |

As shown in the above table, as the concentration of the triazine is increased, with or without an overcoat, the contrast of the element is decreased without loss of toe speed.

The invention has been described in detail with particular reference to certain preferred embodiments thereof, but it will be understood that variations and modifications can be effected within the spirit and scope of the invention.

I claim:

1. A light-sensitive image-forming composition, comprising, in admixture:

(a) a reducing cobalt(III) complex;

(b) a reducing-agent precursor which forms, in the presence of reduction products of said complex, a reducing agent for said cobalt(III) complex; and (c) an organic oxidizing agent capable of functioning as an antifoggant in said composition.

2. A composition as defined in claim 1, wherein said oxidizing agent is a halogenated compound.

3. A composition as defined in claim 1, wherein said oxidizing agent has the structure:

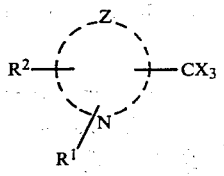

wherein:

$R^1$ and $R^2$ are the same or different and each is $CX_3$, H, or $CH_3$;

X is halogen; and

Z is the number of nonmetallic atoms necessary to complete one or more aromatic rings containing one or more hetero atoms.

4. A composition as defined in claim 3 wherein said oxidizing agent is a triazine.

5. A composition as defined in claim 1, 2 or 3 wherein said agent is 2,4-bis(tribromomethyl)-6-methyl-s-triazine.

6. A composition as defined in claim 1 or 2 wherein said oxidizing agent is tribromomethyl sulfonyl benzothiazole.

7. An imaging element having improved processing latitude for a controlled image definition, comprising:

a support, and on the support, a light-sensitive image-forming composition comprising in admixture:

(a) a reducible cobalt(III) complex;

(b) a reducing-agent precursor which forms, in the presence of reduction products of said complex, and a reducing agent for said cobalt(III) complex; and (c) an organic oxidizing agent capable of functioning as an antifoggant in said composition.

8. An element as defined in claim 7, wherein said oxidizing agent is a halogenated compound.

9. An element as defined in claim 7, wherein said oxidizing agent has the structure:

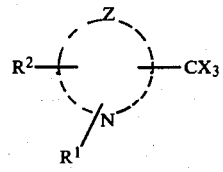

wherein:

$R^1$ and $R^2$ are the same or different and each is $CX_3$, H, or $CH_3$;

X is halogen; and

Z is the number of nonmetallic atoms necessary to complete one or more aromatic rings containing one or more hetero atoms.

10. An element as defined in claim 9, wherein said oxidizing agent is a triazine.

11. A light-sensitive image-forming composition comprising, in admixture:

(a) a reducible cobalt(III) complex;

(b) a compound containing a conjugated π-bonding system and which forms a tridentate chelate with cobalt(III); and (c) an oxidizing agent capable of functioning as an antifoggant in said composition.

12. A composition as defined in claim 11, wherein said compound is 1-(2-pyridylazo)-2-naphthol.

13. A composition as defined in claim 11, wherein said compound is 1-(2-pyridylazo)resorcinol.

14. In an electromagnetic radiation-responsive recording material comprising a support having formed thereon a layer of an electromagnetic radiation-responsive composition, said layer containing in (1) a binder, (2) a cobalt(III) complex, and (3) a compound which contains a conjugated double bond and can form a tridentate chelate ligand with trivalent cobalt, the improvement wherein said layer further contains (4) an organic oxidizing agent capable of functioning as an antifoggant in said composition.

15. A method of forming an image, comprising the steps of (a) imagewise exposing to activating radiation a composition comprising, in admixture a reducible cobalt(III) complex; a reducing-agent precursor which forms, in the presence of reduction products of said complex, a reducing agent for said cobalt(III) complex; and an organic oxidizing agent capable of functioning as an antifoggant in said composition; and (b) developing the image by heating said composition.

* * * * *

UNITED STATES PATENT AND TRADEMARK OFFICE

CERTIFICATE OF CORRECTION

PATENT NO. : 4,292,399

DATED : September 29, 1981

INVENTOR(S) : Anthony Adin

It is certified that error appears in the above-identified patent and that said Letters Patent are hereby corrected as shown below:

Col. 9 and 10, line 1, the part of the formula reading

" 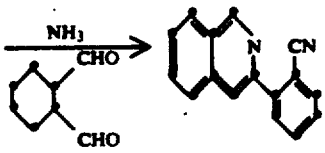

"

should read

-- 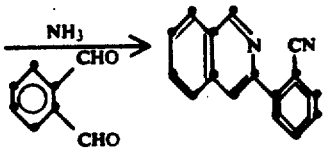

--

Col. 18, line 28 reading " Example The procedure of " should read -- The procedure of Example 7 --.

Signed and Sealed this

First Day of June 1982

[SEAL]

Attest:

GERALD J. MOSSINGHOFF

Attesting Officer

Commissioner of Patents and Trademarks